United States Patent [19]

Chow

[11] 4,280,379

[45] Jul. 28, 1981

[54] REVERSIBLE RATCHET DRIVE

[76] Inventor: Kirk K. Chow, Farmers Branch, Dallas, Tex. 75234

[21] Appl. No.: 111,471

[22] Filed: Jan. 11, 1980

[51] Int. Cl.[3] ..... B25B 13/46

[52] U.S. Cl. ..... 81/62; 192/43.1

[58] Field of Search ..... 81/62, 63; 192/43.1; 145/75

[56] References Cited

U.S. PATENT DOCUMENTS

| | | | |
|---|---|---|---|
| 2,020,883 | 11/1935 | Gagne | 81/63 |
| 2,989,881 | 6/1961 | Lavietes | 145/75 |
| 3,337,014 | 8/1967 | Sandrick | 81/63 |

*Primary Examiner*—James L. Jones, Jr.

*Attorney, Agent, or Firm*—Michael G. Berkman

[57] ABSTRACT

In a ratchet tool having a toothed driving, a complementary coaxial, generally cylindrical rotatable toothed core within the ring, and a core-carried pivotal toothed double-ended pawl secured within the core and selectively positionable to intercouple the driving ring with the core for positively driving a core-carried tool element in each of two opposite torque-transmitting modes, improved means for pivotally shifting the pawl to a selectable mode of torque-transmitting core rotation, the improvement comprising finger actuable pawl-shifting means responsive to finger pressure applied along a vector which includes a force component directed axially into the core to effect, through intercoupling linkage, pivotal radial shifting of the pawl, alternately, between first and second driving-ring-engaging operational positions, and in which the pawl shifting means is conveniently manipulable with the same hand used to hold and to operate the tool. An additional important feature of the invention is that there is provided means whereby the tool user may palpably or visually readily perceive in which rotational mode the tool is set.

9 Claims, 14 Drawing Figures

REVERSIBLE RATCHET DRIVE

The present invention relates to an improved reversible ratchet drive for a hand-operated tool such as a socket wrench. More particularly, the invention is directed to an improved reversing mechanism for socket type ratchet drives, the reversing mechanism being conveniently manipulable with the same hand used to operate the tool.

BACKGROUND OF THE INVENTION

Ratchet wrenches and tools of the type in which the present invention finds utility have been long established in the relevant art. Many and varied types of ratchet and drive reversing mechanisms have been described in the literature, and some of these mechanisms have been adopted in commercial products sold for use by mechanics. The prior art structures each invoke substantially the same mechanical principles, and in each case, rotational force impressed upon a lever arm or wrench handle exerts rotational force on a tool element or workpiece, the applied rotational force coinciding with the axis of rotation of the tool handle. In each such tool, rotation of the handle in one direction will cause positive engagement of driving and driven ratchet teeth which interlock within the tool head. In such ratcheting devices, counter-rotation of the tool handle effects disengagement of the ratchet teeth to permit the drive handle to be shifted in the opposite direction for subsequent forward reactivation and drive.

A principal area of investigation and of distinction between the various ratchet tools of the prior art is the configuration of an indexing element or toothed pawl and the manner in which it is caused to shift, pivot or slide for enabling reversal of the drive direction of the tool element supported by the ratchet tool. Typically, the pawl is caused to shift between two opposed positions in which the toothed ends of the pawl engage, sequentially, at annularly spaced positions within an encircling toothed driving ring or collar of the tool head, each such shift being correlated with either clockwise or counterclockwise torque-transmitting engagement between the driving ring or collar and a driven, coaxial body or core coupled to the collar. Conveniently, the core carries shank or boss means for securement of a tool element thereto.

While many of the prior art ratchet wrenches and related tools are generally suitable for their intended uses, such tools do exhibit certain shortcomings. For example, in ratchet drive structures of the compact type and utilizing "round head" drive rings or collars, it has not heretofore been found feasible to reverse the direction of drive while retaining the wrench in its functional position on a workpiece or tool element to be driven. Rather, it has been necessary either to bring one's other hand into use to rotate a pawl-shifting mechanism so as to reverse the direction of drive, or alternatively, it has been necessary to disengage the tool from the tool element to effect the required or desired reversal of the driving mechanism. It is to the solution of this and related problems that the present invention is directed.

SUMMARY OF THE INVENTION

A principal feature of the invention is that it provides a reversible ratcheting type driving tool in which reversal of the drive direction is conveniently achieved using the same hand in which the tool is held and manipulated. A related feature of the invention is that there is provided a reversing control mechanism which is effectively actuable through the use of one's thumb or forefinger. The reversal may be achieved without releasing the wrench from its manipulative position on a workpiece, and may be accomplished using the same hand which holds the ratchet wrench.

Still another feature of the improved ratchet drive of the invention is that the directional reversing indexing mechanism is shifted between each of its two opposed rotational modes through the application of digital pressure on a finger contact element which projects above a top face of the wrench head and which does not require the application of a rotational force. That is, the reversing indexing mechanism of the present invention is actuated through force applied such as to produce a component projecting axially into the face of the tool head. The improved structure obviates any need to grasp a bar-like key and to rotate the same in the tool head.

A substantive feature of the invention is that the rotation-reversing finger contact element carries means for palpably noting both visually or through touch, particular rotational drive modes for which the apparatus is set.

A critical feature of the improved ratchet reversing mechanism of the present invention is that drive reversal is effectively achieved through digital pressure applied axially inwardly of the face of the tool head. The applied pressure is impressed using either the thumb or a finger of the same hand used to grip and manipulate the drive tool, and the applied functional force vector includes a component projecting axially into the body of the tool head.

In a preferred embodiment of the invention, the improvements and the advantageous features are incorporated in a ratchet drive of the type which includes a driving ring or collar to which a handle is connected, a driven core or body rotatably journalled within the drive collar and coupled thereto through a shiftable, double-ended, toothed pawl. The pawl is, in turn, moved between two limiting positions whereby either of the opposed toothed ends of the pawl is brought, sequentially, into meshing engagement with mating teeth carried on an inner periphery of the drive ring for establishing a torque-transmitting relation in either of opposed rotation directions. Principal features of the invention pertain to the improved mechanism and method whereby the shifting of intercoupling pawl is effected.

In accordance with the practice of the present invention, certain noted shortcomings of the prior art structures have been obviated, and a highly functional and practical device has been provided. In particular, the present invention makes it possible for the user of the ratchet drive conveniently and quickly to perceive the set mode of rotation and readily to reverse the direction of torque transmitting rotation through a simple manipulation by applying digital pressure and using the same hand used to hold the tool.

Other and further objects, features, and advantages of the invention will become evident upon a reading of the following specification taken in conjunction with the drawing.

DESCRIPTION OF THE PREFERRED EMBODIMENTS

Figure 1:
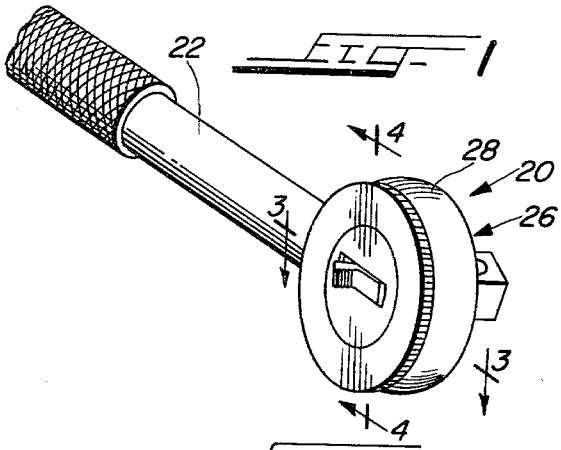
FIG. 1 is a perspective view of a wrench embodying the present invention.

The aims and objects of the invention are accomplished by providing in a ratchet drive wrench or similar article an improved reversing mechanism for noting and for selecting the mode of rotation of the torque-transmitting element of the drive wrench. The invention finds specific utility in that type of drive which has a "round head", and in which all of the rotation reversing mechanism is carried in the head itself and, specifically, in the driven core or body of the tool head.

Each of the several preferred embodiments of the invention has, in common with the others, a finger (or thumb) pressure-responsive shifting mechanism which extends outwardly from a face of the tool head and which is readily manipulable through applied digital pressure to effect a reversal of the torque-transmitting linkage so as to achieve, selectively, clockwise and counterclockwise rotation of the driven core or body of the tool.

Referring now to the drawings, and more particularly to FIGS. 1 through 5, there is shown one preferred embodiment of the reversible ratchet drive of the invention provided for illustrative purposes and not to be construed in any limiting sense. The ratchet wrench 20 illustrated includes a handle 22 to one end of which is connected a tool head 26 comprising a generally cylindrical driving ring or collar 28 formed on its inner generally cylindrical surface 30 with an uninterrupted series of axially extending ratchet teeth 34 evenly and circumferentially spaced around the inner wall surface 30 of the driving ring 28 and projecting radially inwardly thereof.

A driven body or core 40 rotatably journalled in the collar 28 and consitituting the torque-transmitting element of the tool head 20 has a generally cylindrical body 42 formed with a transverse recess or cavity 46 extending radially inwardly of and from an encircling bounding cylindrical surface 48 of the core 40.

A shank or boss 52 of non-circular transverse cross-section extends axially from one endface 56 of the core body 42 for attachment of interchangeable tool elements. At it opposite end the core body 42 is formed with an enlarged-diameter, collar-like flange 60, a bounding peripheral marginal edge of which is knurled 64 of facilitate manual rotation thereof and of the core body 42 attached thereto.

The cylindrical body 42 of the core 40 is formed near its end adjacent the shank 52 with an annular groove 70 adapted to receive therewithin an annular retaining spring washer or snap ring 74 the outer diameter of which is slightly greater than that of the internal diameter of the driving ring 28. As clearly shown in FIG. 3, the outer diameter of the core body 42 is only slightly less than the inner diameter of the drive ring 28 so that the core 42 is rotatably received and supported within the drive ring 28 with the enlarged annular flange 60 abutting a top face 80 of the drive ring 28 and the snap ring 74 seated in its cooperating groove 70 to engage a rear face 84 of the drive ring 28 to lock the core body 40 against inadvertent axial displacement or withdrawal from the drive ring 28.

Figure 5:
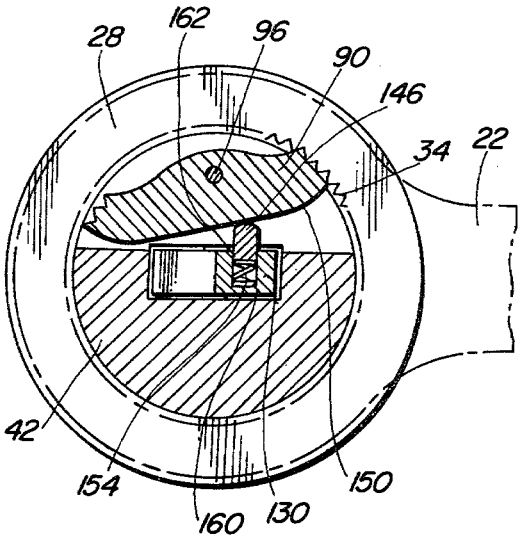
FIG. 5 is a cross-sectional view taken on the lines 5—5 of FIG. 4 and showing the pivotal pawl and its actuator.
Figure 2:
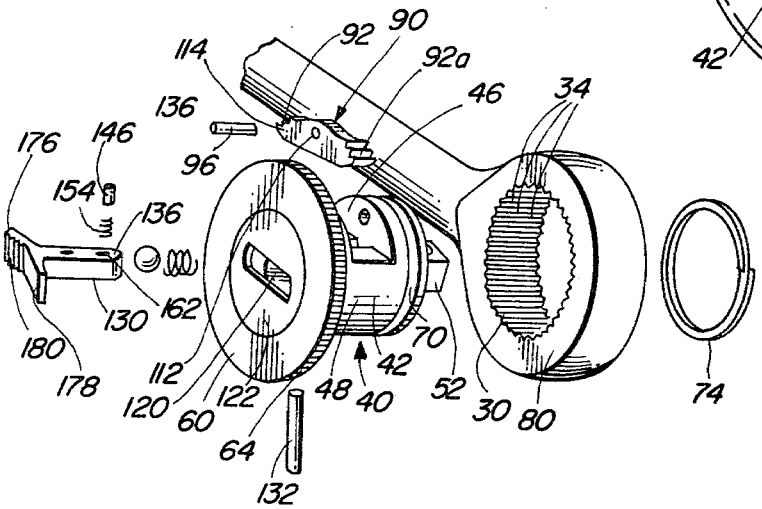
FIG. 2 is an exploded view of one embodiment of the wrench of the invention with a portion of the handle broken away.

Referring further to FIGS. 2 through 5, a double-ended reversible wing-like pawl 90 having ratchet teeth 92, 92*a* at its opposed ends is pivotally mounted on a rod 96 secured at its opposed ends 98 and 100 in opposed bounding walls 104 and 106 of the cavity 46, the rod 96 passing through a cooperating slot 112 extending transversely through the body 114 of the pawl 90 at a position between the opposed ends thereof. As shown, the pawl 90 is so oriented within the recess 46 formed in the body 42 of the core 40 that the teeth 92 and 92*a* face radially outwardly from the core body 42 for presentation against and interengagement with the complementary facing teeth 34 of the drive ring 28 (FIG. 5).

The core body 42 is formed with a slot 120 extending axially into the core body 42 from an upper flat surface 122 thereof, the slot 120 intersecting and communicating with the transverse recess 46 in which the pawl 90 is housed. A shaft 130 mounted on a pivot pin 132 secured in the body 42 of the core 40 extends axially into the slot 120 so that the inwardly directed lower end portion 136 of the shaft 130 invades a spatial zone communication with the recess 46 formed in the core body 42.

In the embodiment of the invention pictured in FIGS. 1 through 5, a prod or probe 146 is secured at the lower end of the shaft 130 to project normally thereof and to abut and bear against a camming surface or face 150 of the pawl 90 at a side thereof generally opposed to the pawl-carried teeth 92 and 92*a*, as shown in FIG. 5. The probe 146 is spring biased by means of a compression spring 154 interposed between the prod 146 and an end wall 160 of a slot 162 formed in the shaft 130 in which the prod 145 rides.

Figure 3:
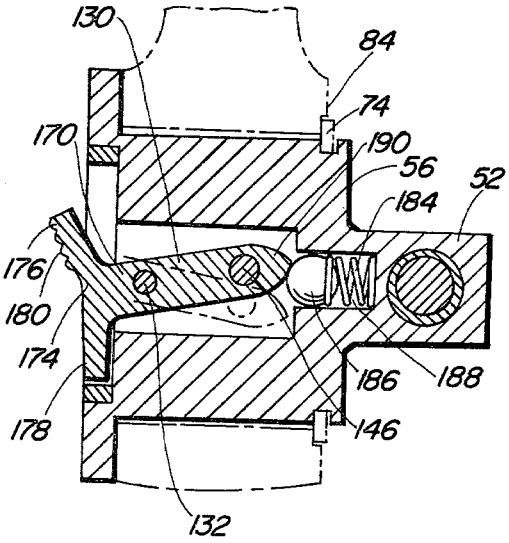
FIG. 3 is an enlarged cross-sectional view through the head of the wrench, taken on the lines 3—3 of FIG. 1 and showing one form of the finger-actuable pawl-shifting mechanism.
Figure 4:
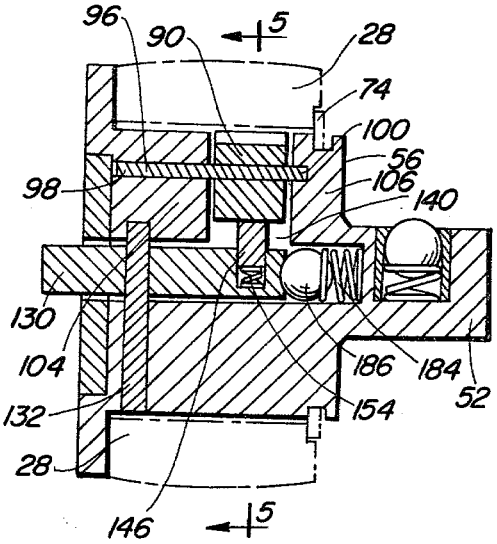
FIG. 4 is an enlarged cross-sectional view through the head of the wrench, taken on the lines 4—4 of FIG. 1.

At its outwardly directed end 170, the shaft 130 is formed with a surmounting cross bar 174 comprising a pair of laterally extending arms 176 and 178 so oriented that in each of the opposed pivotal positions of the shaft 130 one of the arms 176 and 178 is elevated with respect to the other and projects above the top face 122 of the core flange 60, as clearly indicated in FIG. 3. One of the arms 176 is conveniently ribbed 180 or colored to render it distinguishable from the other whereby one may note palpably, both visually and by touch, the particular rotational mode setting of the tool.

A detent assembly consisting of a spring 184 and a sphere 186 housed in a socket 188 formed in the shank 52 and opening into the recess 46 at a point below the inner end 190 of the shaft to ensure positive positioning of the shaft 130 in each of its opposed limiting pivotal positions, as indicated schematically in FIG. 3. As the shaft 130 is caused to pivot by the application of digital pressure to one of the ramp-like wing flanges or arms 176 and 178, the shaft-carried prod 146 is caused to bear along the camming surface 150 of the pawl 90 and to cause the pawl 90 to pivot so that its opposite toothed end couples with and establishes driving engagement with the complementary teeth 34 of the drive ring 28.

It will be appreciated from the foregoing detailed description considered in conjunction with the drawings that, in that embodiment of the invention above described, in order to reverse the direction of applied rotation torque, it is necessary merely to apply finger pressure downwardly upon the upstanding arm 176 of the pawl shifting shaft 130 or axially inwardly of the core 40 to pivot the shaft 130 on its support pin 132 thereby to urge the prod 146 to ride along the camming surface 150 of the pawl 90 and to pivot the pawl 90 from a first operative position to a second.

In fact and in effect, the finger-pressure applied includes a force extending along a vector having a component directed substantially axially into the core 40 of the ratchet wrench 20. This is in marked and significant contrast with prior art devices in which the mechanism for effecting a shift in rotational driving torque is by means of a fingerpiece which must be turned, such a mechanism being essentially impossible to manipulate by means of finger pressure.

A unique advantage achieved as a result of the structure described herein is that the shift by the user from a first to a second operational mode of the ratchet wrench is conveniently accomplished using the same hand which is employed to hold the wrench, and without relinquishing one's hold on the wrench. This advantage is a feature of each embodiment of the present invention.

Figure 6:
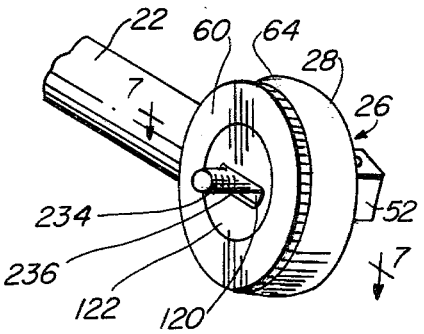
FIG. 6 is a perspective view, with the handle partially broken away, of a second embodiment of the wrench of the invention.
Figure 7:
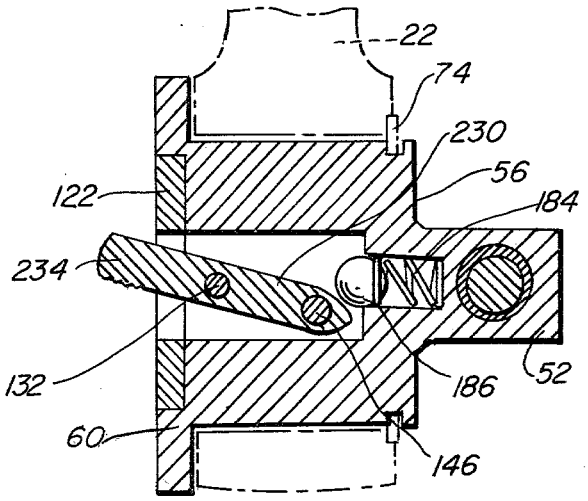
FIG. 7 is a cross-section view taken along the lines 7—7 of FIG. 6 and showing an alternate form of the finger-actuable pawl-shifting mechanism.

In the embodiment of the invention illustrated in FIGS. 6 and 7, the various component elements, where essentially the same as those described above, are identified using the same corresponding numbers. In substance, the embodiment of FIGS. 6 and 7 differs from that previously described in the physical form of the finger-pressure-responsive actuator. Specifically, the pawl-shifting pivotal shaft 230 extends axially outwardly and beyond the face 122 of the tool head 28 to provide a finger-shiftable bar 234 which is an extension of the shaft 230. In order to effect a reversal of the torsional drive mode of the tool illustrated, it is again necessary merely to apply digital pressure to pivot the shaft 230 on the supporting pivot pin 132, thereby again to move the probe 146 along the camming surface 150 of the pawl 90 to pivot the pawl on its support pin 96, all as indicated schematically or otherwise identified, in FIG. 5. A "side" of the shaft, extension 234 may be grooved or ribbed 236, so that particular rotation mode will be readily evident.

Figure 8:
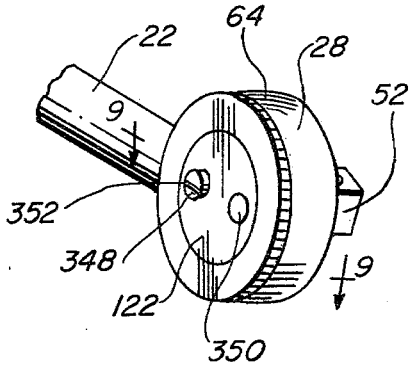
FIG. 8 is a perspective view, with the handle partially broken away, of a third embodiment of the wrench of the invention.
Figure 9:
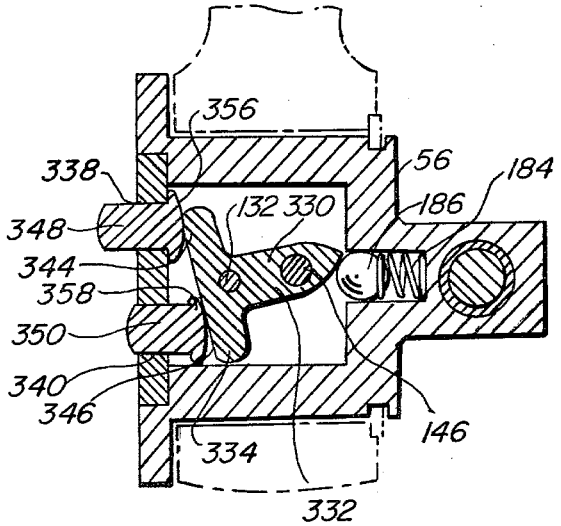
FIG. 9 is a cross-sectional view taken along the lines 9—9 of FIG. 8 and showing still another form of the finger-actuable pawl-shifting mechanism.
Figure 10:
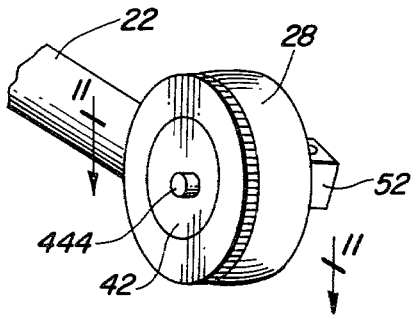
FIG. 10 is a perspective view, with the handle broken partially away, of a fourth embodiment of the wrench of the invention.

In the embodiment of the ratchet drive illustrated in FIGS. 8 and 9, a somewhat modified structure for shifting the pawl 90 between its proposed limit positions is shown. The overall length of the pivotal shaft 330 which controls the shifting of the pawl 90 has been shortened and its axially outwardly directed end 332 is surmounted by a cross bar 334. The end face 122 of the core body 42 has two through bores 338 and 340 spaced for axial spatial correspondence with laterally extending end portions 344 and 346 of the cross bar 334. Slidably disposed in the bores 338 and 340 are a pair of push buttons 348 and 350, each conveniently flanged 356 and 358 to preclude axial dislodgement outwardly of the assembly.

In the pawl actuating mechanism of the invention embodiment illustrated in FIGS. 8 and 9, the user need again merely apply digital pressure axially inwardly against that button which projects outwardly from the face 122 of the core body. Such pressure is transferred to the cross bar 334 and is effective to pivot the shaft 330 on its pivotal support 132 and, concurrently, to slide the probe 146 along the camming surface 150 of the pawl 90 to shift the pawl to an opposite limit position, again, all as indicated schematically in FIG. 5. One 348 of two buttons may be suface-marked 352 or color coded to enable the user of the tool readily to perceive in which rotational mode the drive is set. As in the previously described embodiments, the reversal of the ratchet mode is conveniently achieved by using same hand in which the wrench is functionally held, and without releasing one's grip on the wrench handle 22.

Figure 11:
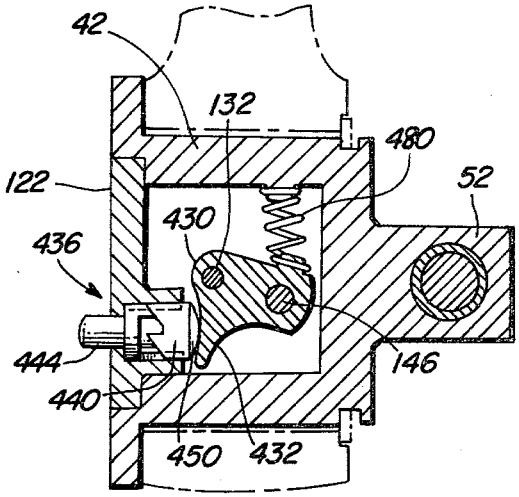
FIG. 11 is a cross-sectional view taken along the lines 11—11 of FIG. 10 and showing still another form of the finger-actuable pawl-shifting mechanism with the pawl-shifting shaft in one functional mode.
Figure 14:
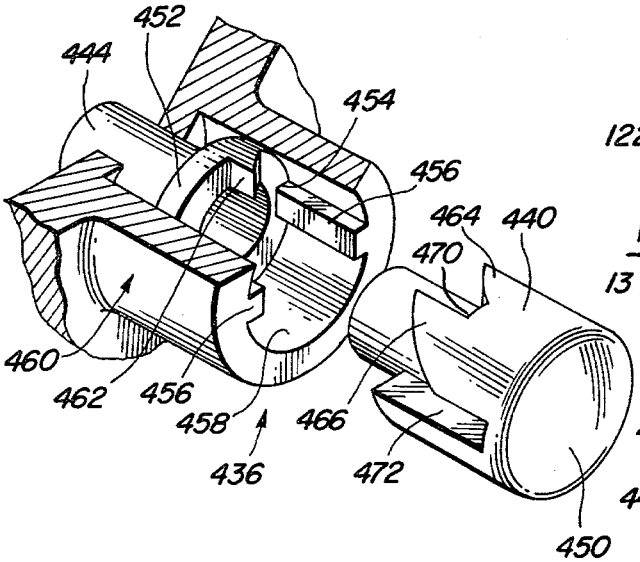
FIG. 14 is an enlarged isometric view, with portions cut away, showing the pawl-shifting stepping assembly of the embodiment of the invention illustrated in FIGS. 10, 11 and 12.
Figure 12:
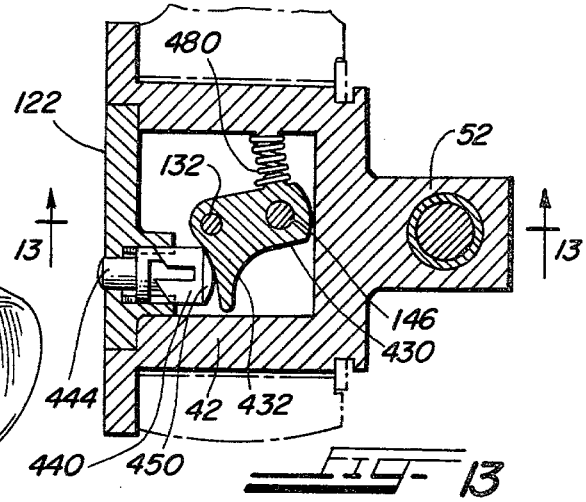
FIG. 12 is a view similar to FIG. 11 but showing the pawl-shifting mechanism in a second operational mode.
Figure 13:
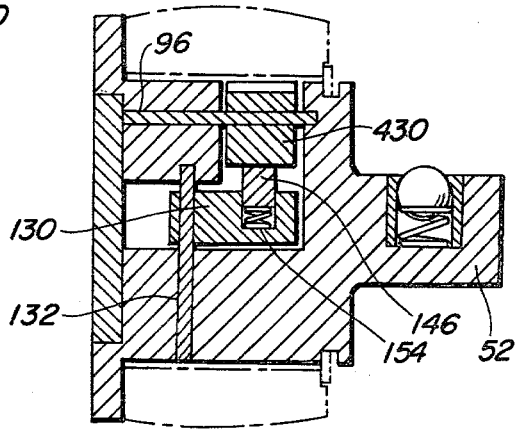
FIG. 13 is a cross-sectional view taken substantially on the lines 13—13 of FIG. 12.

Another embodment of a reversible ratchet drive invoking the principles of the present invention is shown in FIGS. 10 through 14. This embodiment utilizes a single button as a finger control for alternately shifting the pawl 90 between its opposed limiting positions. As best seen in FIGS. 11, 12 and 14, the pawl-pivoting shaft 430 is formed with a laterally extending wing 432, and the shaft 430 is pivoted by means of a stepping assembly 436 consisting of driven rotatable toothed plug 440, and a driving toothed push button 444 coaxially disposed and supported in the tool core body 42. A finger contact end 446 of the button 446 of the button 444 projects above the surface 122 of the core body 42 and a shaft-wing-engaging end 450 of the plug 440 bears against the wing 432 of the pivot shaft 430.

The button 444 is formed with an annular collar 452 the latter being grooved 454 and riding on rails 456 projecting radially inwardly of and extending along an inner surface 458 of the button securing flange 460. The collar 452 carries a tooth 462 for engaging and rotatably stepwise advancing the plug 440 through stressed axial engagement of the stepping tooth 462 against cooperating alternately arranged teeth 464 and 466 annularly disposed on a facing end of the plug 440 and defining shallow and deep slots 470 and 472. Thus, upon successive sequential depression of the button 444, the plug 440 is caused to rotate one-fourth turn, stepwise, and is displaced in each of two distinct modes of inward or axial displacement against the shaft wing 432. Each mode is correlated with one of two corresponding different pivotal positions of the pawl-shifting shaft 430, as indicated schematically in FIGS. 11 and 12. In the illustrative arrangement shown, the shaft 340 is biased into resilient stressing contact against the base 450 of the plug 440 by means of a spring 470.

While preferred embodiments of the invention have been illustrated and described, other variations may be made utilizing the inventive concepts herein disclosed. It is intended that all such variations be considered as within the scope of the invention as defined in the following claims.

What is claimed is:

1. A reversible ratchet drive comprising a handle-carried tool head including a driving ring, a core having a generally cylindrical rotational body sleeved within and concentric with said ring, a tool-element-engaging shank extending axially downwardly from said core, said driving ring having a cylindrical inner surface, an uninterrupted series of axially extending ratchet teeth formed in an evenly and circumferentially spaced around said inner surface of said ring and projecting radially inwardly thereof, said body of said core having a transverse recess formed therein and extending radially inwardly of and from an encircling bounding periphery of said core, a double-ended reversible pawl pivotally secured in said recess, said pawl having ratchet teeth at each of its opposed ends, said ratchet teeth facing radially outwardly and presented toward said ratchet teeth of said driving ring for mating therewith, rod means carried axially in said core and pivotally supporting said pawl in said recess for arcuate displacement of opposed toothed ends of said pawl radially inwardly and outwardly in said transverse recess in sequence, for selectively presenting either of said opposed toothed ends to said driving ring, said ratchet teeth of said pawl being complementary with said teeth of said driving ring for selective independent ratcheting and driving engagement therewith, reversibly to impart rotative clockwise and counterclockwise torque-transmitting motion to said core upon rotation of said driving ring, said pawl having a camming surface for application of pawl shifting pressure thereto, said core being formed with slot means extending axially into said core from an upper surface thereof and intersecting said transverse recess formed therein, said pawl actuating means for selectively pivotally shifting said pawl to each of a pair of opposed limiting positions correlated with reversible intercoupling ratcheting and driving engagement of each toothed end of said pawl with complementary mating teeth of said driving ring, said pawl actuating means including shaft means projecting generally axially into said core through said slot means formed therein, said shaft means reaching, at a lower end portion thereof, into a spatial zone adjacent said transverse recess, finger-pressure-responsive means for manually pivoting said pawl, said finger-pressure-responsive means including a finger contact portion projecting above a top surface of said core, said finger contact portion being responsive to pressure applied thereagainst along a force vector having a component directed axially into said core and operative to effect a shift of said pawl alternately between first and second opposed limiting positions and reversibly and ratchetly to intercouple a toothed end of said pawl drivingly with mating said ratchet teeth of said driving ring.

2. The structure as set forth in claim 1 wherein said finger-pressure-responsive means includes a pair of arms surmounting and connected to said shaft means and extending generally normally thereto, means pivotally supporting said shaft means, an end portion of one arm of said pair of arms being elevated with respect to the other of said arms, and wherein said camming surface of said pawl extends laterally therealong between opposed ends of said pawl on a side thereof opposite said ratchet teeth carried thereby, and further comprising prod means and means anchoring said prod means in said core to bear against said camming surface of said pawl, said finger-pressure-responsive means being responsive to pressure applied downwardly against an elevated end portion of one of said arms to pivot said shaft means of said pawl actuating means and said prod means to shift said pawl from a first to a second operative position of engagement with said driving ring.

3. The structure as set forth in claim 1 wherein said finger-pressure-responsive means includes an upper end portion of said shaft means projecting through and upwardly of a top surface of said core, and wherein said camming surface of said pawl extends laterally therealong between opposed ends of said pawl on a side thereof opposite said ratchet teeth carried thereby, and further comprising means pivotally supporting said shaft means, and prod means and means anchoring said prod means in said core to bear against said camming surface of said pawl, said upper end portion of said shaft means being accessible to and responsive to finger pressure applied thereto to effect pivotal shifting of said shaft means and to slide said prod means along said camming surface of said pawl to pivot said pawl for selective ratcheting positioning thereof against said driving ring to provide torque transmitting engagement between said driving ring and said core.

4. The structure as set forth in claim 1 and further comprising means pivotally supporting said shaft means, a cross bar surmounting said shaft means and extending normally thereof and with said transverse recess of said core, prod means and means anchoring said prod means in said core to bear against said camming surface of said pawl, and wherein said finger-pressure-responsive means includes a pair of spaced, axially shiftable alternately depressible stup plugs extending through a top end plate of said core into said recess thereof and in abutment with corresponding opposed ends of said cross bar therebeneath, securement means to preclude inadvertant axial dislodgment of said plugs from said end plate of said core, said plugs being responsive to finger pressure applied thereto, alternately, to stress opposed ends of said cross bar and to pivot said shaft means and to slide said prod means along said camming surface of said pawl arcuately to shift said pawl selectively to each of said pair of opposed limiting positions.

5. In a ratchet wrench including a handle-mounted driving ring carrying internal circumferentially disposed ratchet teeth, a cylindrical core sleeved within and rotatable in said driving ring, connector means carried by said core at an axial end thereof for attachment of a tool element thereto, a pivotally-supported double-ended ratchet-toothed pawl secured in said core and operating mechanically to intercouple said core with said driving ring through interengagement of complementary respective ratchet teeth of said driving ring and said core-carried pawl and imparting, selectively, bidirectional rotation to said core through application of annular rotational forces to said driving ring, means for selectively positioning said pawl to either of two limiting positions for controlling the direction of driving rotation of said core during operational use of said wrench, the improvement wherein said means for selectively positioning said pawl comprises:

a finger-pressure-responsive pawl actuator, said actuator including shaft means projecting generally axially into said core for effecting pivotal shifting of said pawl between two limiting positions correlated with clockwise and counterclockwise driving rotation of said core, and wherein said shaft means is responsive to pressure applied thereto along a force vector having a component directed axially into said core, and means coupling said shaft means and said pawl for translating axial forces applied to said shaft means into pawl pivoting radial forces applied to said pawl, said improvement enabling one using the same hand in which the wrench is held conveniently to reverse the driving direction of the wrench by applying finger pressure to said shaft means of said acutator.

6. The structure as set forth in claim 2 and further comprising spring means interposed between said shaft means and said prod means for urging said prod means to bear resiliently against said camming surface of said pawl.

7. The structure as set forth in claim 1 wherein said core is formed with an enlarged-diameter collar surmounting said body of said core, said collar defining at an underface thereof an annular radial flange abutting a facing top edge portion of said driving ring, a bounding marginal edge of said collar being knurled to facilitate manual rotation thereof and of said core, a circumscribing annular groove formed in the body of said core in a zone immediately below a core-encircling lower edge of said driving ring, a snap ring seated in said groove, said snap ring having an outer diameter greater than that of said core body, including a terminal outer portion of said snap ring projecting radially beyond said body of said core to engage an undersurface of said driving ring and to lock said core against inadvertant axial withdrawal from said driving ring.

8. The structure as set forth in claim 1 and further comprising sensing means carried by said finger contact portion of said finger-pressure-responsive means for facilitating ready palpable sensing of the particular position in which said finger contact portion of said finger-pressure-responsive means is disposed, for enabling one to know the rotational direction in which said core will be driving upon actuation of the handle of said ratchet drive.

9. The structure as set forth in claim 1 wherein said finger contact portion of said finger-pressure-responsive means comprises a single button extending axially into said core and having an end projecting through and upwardly of a top surface of said core, wing means connected to and extending laterally from said shaft means for application thereto of forces to pivot said shaft means, a stepping assembly coaxial with said button and in alignment with said wing means and interposed between said button and said wing means of said shaft means, said stepping assembly comprising inter-engaging arrays of annularly distributed tooth means including a rotatable annular array of teeth of two different effective lengths interposed alternately between said button and said shaft means, digital pressure applied to said button axially thereof establishing stressing engagement between said arrays of said tooth means and effecting an incremental rotational advance of said annular array of teeth alternately and sequentially between a first and a second degree of axial displacement of said wing means to pivot said shaft means and to shift said pawl selectively and sequentially to bring each of said opposed toothed ends thereof into engagement with teeth of said driving ring.

* * * * *

UNITED STATES PATENT OFFICE

CERTIFICATE OF CORRECTION

Patent No. 4,280,379 Dated July 28, 1981

Inventor(s) KIRK KOO CHOW

It is certified that error appears in the above-identified patent and that said Letters Patent are hereby corrected as shown below:

IN THE CLAIMS:

Claim 1, Line 3, delete "rotational" and substitute therefor ---rotatable---

Claim 1, Line 18, delete "an" and substitute therefor ---and--

Claim 4, Line 5, delete "with" and substitute therefor ---within---

Claim 4, Line 12, delete "stup" and substitute therefor ---stub---

Signed and Sealed this

Twenty-second Day of September 1981

[SEAL]

Attest:

GERALD J. MOSSINGHOFF

Attesting Officer

Commissioner of Patents and Trademarks